United States Patent [19]

Kompanek et al.

[11] Patent Number: 4,512,402

[45] Date of Patent: Apr. 23, 1985

[54] CASING TUNED DOWNHOLE TOOL

[75] Inventors: Harry W. Kompanek; James R. Ligman, both of Santa Barbara; Eric D. Plambeck, Carpinteria, all of Calif.

[73] Assignee: Sona-Tool Development Ltd., Newport Beach, Calif.

[21] Appl. No.: 493,597

[22] Filed: May 11, 1983

[51] Int. Cl.[3] ..... E21B 43/25

[52] U.S. Cl. ..... 166/249; 166/177

[58] Field of Search ..... 166/177, 249

[56] References Cited

U.S. PATENT DOCUMENTS

| | | | |
|---|---|---|---|
| 3,578,081 | 5/1971 | Bodine | 166/177 |
| 3,583,677 | 6/1971 | Phillips | 166/177 |
| 4,257,482 | 3/1981 | Kompanek | 166/249 |
| 4,342,364 | 8/1982 | Bodine | 166/249 |

*Primary Examiner*—Stephen J. Novosad
*Assistant Examiner*—William P. Neuder
*Attorney, Agent, or Firm*—Ellsworth R. Roston; Charles H. Schwartz

[57] ABSTRACT

A casing is disposed in an oil well and is constructed to provide for the flow of oil in the well. For example, the casing may be cylindrical and may be perforated in its cylindrical wall. The casing is resonant in a hoop mode at a particular fundamental frequency. This fundamental frequency may be in the order of approximately 400 hertz. A transducer includes a transducer member disposed within a tubing in spaced relationship to the tubing. The transducer member may be a ceramic slotted at one end and supported by the tubing at the other end. A ring may envelope the ceramic member and may be slotted at the same position as the ceramic member. The tubing may be filled with an oil which provides dielectric properties and operates to transmit vibrations from the transducer to the tubing. The transducer may vibrate in the hoop mode at the fundamental frequency of resonance of the casing. The transducer member is energized to obtain the production of vibrations in the transducer in the hoop mode. These vibrations are transmitted to the casing through the oil in the tubing, the tubing and the oil in the casing to produce a resonance of the casing at the particular fundamental frequency in the hoop mode.

19 Claims, 2 Drawing Figures

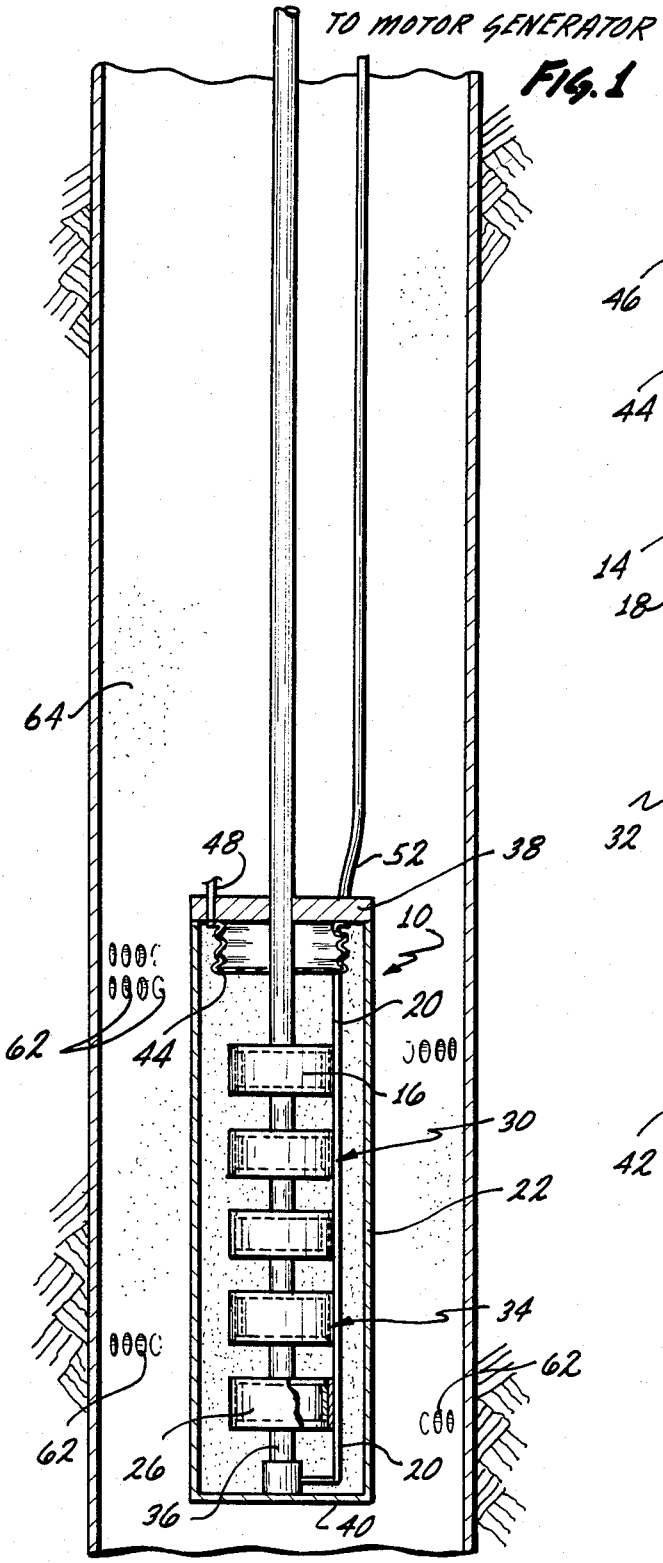
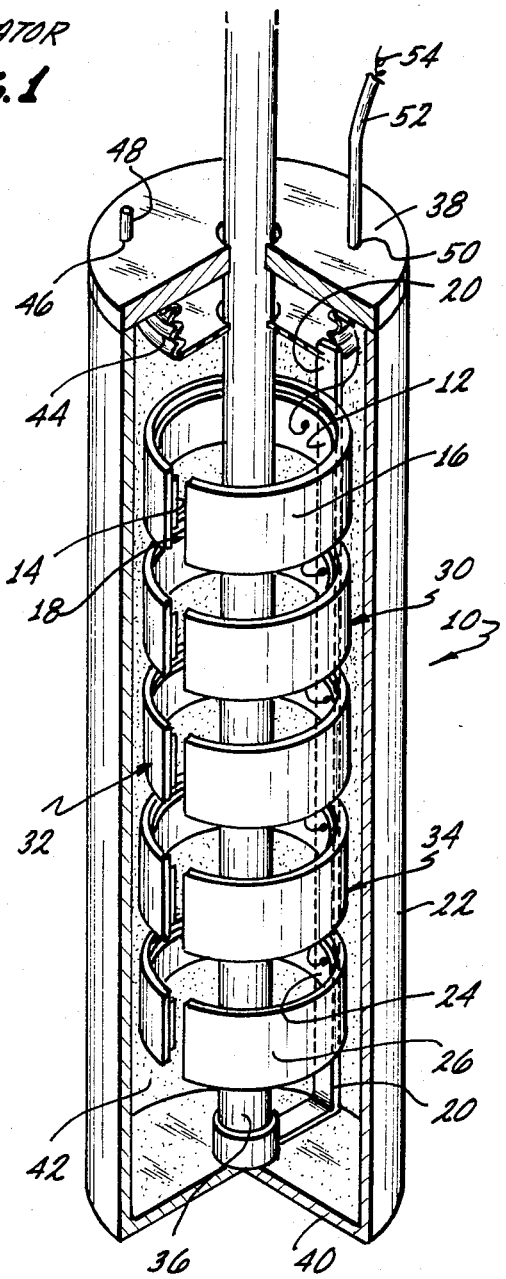
FIG. 2

CASING TUNED DOWNHOLE TOOL

This invention relates to apparatus for enhancing the flow of fluid in an oil well. More particularly, the invention relates to apparatus for employing resonant techniques to enhance the flow of fluid in an oil well while packing gravel and sand to prevent sand from accumulating in the casing and clogging the pump in the well. The invention also relates to a method of facilitating the flow of fluid in an oil well, particularly by using resonant techniques.

As the recovery of oil becomes increasingly expensive and the price of oil rises, a number of different techniques have been employed or attempted to remove oil from a well. These techniques have sometimes involved the production of resonances in the well in the sonic range. Such techniques have been particularly attempted to obtain a secondary recovery of oil. For example, a sonic vibrator is disclosed and claimed in Bodine U.S. Pat. No. 2,437,456. In this patent, longitudinal vibrations are produced by generating a longitudinal sound wave of large amplitude in a heavy resonant pipe. The pipe is in the order of one hundred fifty feet (150') long and is coupled directly to the bottom of the bore hole. The resultant vibrations produce high elastic strains in the bottom of the oil well. These vibrations occur at a half wave frequency of approximately 60 hertz.

The apparatus described in the previous paragraph is disadvantageous in several respects. Since the pipe is in the order of one hundred fifty feet (150') long, it is quite heavy. This has required a considerable amount of energy to be introduced to the apparatus to generate the longitudinal sound waves of large amplitude. Furthermore, the apparatus has not been especially successful in promoting the secondary recovery of oil.

In the secondary recovery of oil, frequencies in the order of 400 hertz been attempted to be generated with the apparatus discussed in the previous paragraph. As will be appreciated, such a frequency is difficult to obtain when the pipe is in the order of one hundred fifty feet (150') long and is heavy. Although the use of resonant techniques is generally known to be desirable in promoting the recovery of oil, no resonant system has been successfully provided to this date to promote the recovery of oil, particularly when the recovery is secondary.

This invention provides apparatus for overcoming the disadvantages discussed above. The apparatus consists of a downhole tool which may vary in length from approximately two feet (2'0") to forty feet (40'0"). The tool vibrates a casing in the hoop or radial mode of the casing at a frequency in the order of four hundred (400) hertz. The frequency constitutes the resonant frequency of the casing, thereby facilitating the production of vibrations of large amplitude in the casing and promoting the flow of fluid in the oil well.

In one embodiment of the invention, a casing is disposed in an oil well and is constructed to provide for the flow of oil in the well. For example, the casing may be cylindrical and may be perforated at various positions in its cylindrical wall. The casing is resonant in a hoop mode at a particular fundamental frequency. This fundamental frequency may be in the order of 400 hertz.

A transducer includes a transducer member disposed within a tubing in spaced relationship to the tubing. The transducer member may be a ceramic slotted at one end and Supported by the tubing at the other end. A ring may envelope the ceramic member and may be slotted at the same position as the ceramic member. The tubing may be filled with an oil which provides a dielectric relationship and which transmits vibrations from the transducer to the tubing. The transducer may vibrate in the hoop mode at the fundamental frequency of resonance of the casing.

Means are operatively coupled to the transducer for energizing the transducer member to obtain the production of vibrations in the transducer in the hoop mode. These vibrations are transmitted to the casing through the oil in the tubing, the tubing and the oil in the casing to produce a resonance of the casing at the particular fundamental frequency in the hoop mode.

In the drawings:

FIG. 1 is a schematic view of an oil well and apparatus included in the oil well to enhance the flow of oil in the oil well, such apparatus constituting one embodiment of the invention; and FIG. 2 is an enlarged fragmentary perspective view illustrating details of construction of the apparatus shown in FIG. 1.

In the embodiment of the invention shown in the drawings, a transducer generally indicated at 10 may include a transducer member 12. The transducer member 12 may be made from a suitable material such as lead zirconate and lead titanate to have piezoelectric properties. The ceramic transducer member 12 is preferably provided with an annular configuration and is preferably slotted axially as at 14. The axial slotting of the transducer member 12 facilitates the production of vibratory energy at high power levels without breaking the transducer.

The transducer member 12 is disposed within a ring 16 which may be made from a suitable material such as aluminum. The transducer member 12 is preferably bonded to the inner surface of the ring 16. The ring 16 is preferably slotted as at 18, the slot being aligned with the slot 14 in the transducer.

The ring 16 may be clamped at a position which is preferably diametrically opposite the slot in the ring. The clamping may be provided by a mounting rod 20 which is suitably attached to a tubing 22. The tubing 22 may be disposed in concentric relationship with the transducer 12 and the ring 14 and may be spaced from the ring. The sleeve 22 is preferably made from a suitable metal such as aluminum or stainless steel.

A transducer member 24 and a ring 26 respectively corresponding to the transducer member 12 and the ring 16 may also be provided. The assembly of the transducer member 12 and the ring 16 and the assembly of the transducer member 24 and the ring 26 are disposed in a spaced, coaxial relationship in the sleeve 22. Slots in the transducer member 24 and the ring 26 may coincide in annular position with the slots in the transducer member 12 and the ring 16. However, the slots in the transducer member 24 and the ring 26 may be angularly displaced from the slots in the transducer member 12 and the ring 16 without departing from the scope of the invention.

The assembly of the transducer member 12 and the ring 16 may be disposed adjacent the assembly of the transducer member 24 and the ring 26. Alternatively, a plurality of assemblies generally indicated at 30, 32 and 34 may be disposed between the assembly including the transducer member 12 and the ring 16 and the assembly including the transducer member 24 and the ring 26.

Thus, as will be appreciated, only one transducer assembly my be employed or any number of transducer assemblies in excess of one may be employed.

A support rod 36 extends axially through the sleeve 20 and the transducer members 12 and 24. The rod 36 may be dependent from the bottom of the pump (not shown). End plates 38 and 40 are disposed at opposite ends of the sleeve 22 and are coupled to the support rod 36 and the mounting rod 20 to provide a support of the sleeve 22.

The sleeve 22 is preferably filled with an oil 42 such as a silicone oil. The oil 42 may be provided with characteristics to lubricate the different parts and to communicate vibrations from the transducer members such as the transducer members 12 and 24 to the sleeve 22. A bellows 44 is preferably disposed adjacent the end plate 38. The bellows 44 expands or contracts with changes in temperature to provide compensations within the sleeve 22 for changes in the space occupied by the oil 42 in accordance with such changes in temperature and pressure.

A passage 46 extends through the end plate 38 and communicates with the hollow interior of the sleeve 22 to provide for the introduction of oil into the sleeve. The passage 46 may be sealed by a plug 48. A passage 50 also extends through the end cap 32. A plug 52 may be provided to seal the passage 50. The passage 50 provides for the introduction of an electrode 54 to the transducer members such as the members 12 and 24 to energize the transducer members with a suitable potential such as a positive potential. The positive potential may be obtained from electronic circuits or from a motor generator. A negative potential may be provided by the electrical grounding of the sleeve 22 or the introduction of a negative potential to the sleeve.

A casing 60 envelops the tubing 22. The casing 60 may be perforated as indicated at 62 to provide for the passage of oil 64 through the perforations 62 into the space between the tubing 22 and the casing 60. The oil 64 in the casing 60 accordingly functions to transmit to the casing vibrations produced in the transducer members such as the transducer members 12 and 24. The casing 60 may be provided with characteristics to resonate at a particular fundamental frequency such as a frequency of approximately four hundred (400) hertz.

The transducer members such as the transducer members 12 and 24, the rings such as the rings 16 and 26 and the tubing 22 are provided with characteristics to resonate at a frequency corresponding to the resonant frequency of the casing 60. This resonant frequency is dependent upon the characteristics of the casing 60. The casings 60 used in the oil fields generally have the following characteristics:

| Outer Diameter in Inches | Inner Diameter in Inches | Percentage of Fields |
|---|---|---|
| 7 | 6.366 | 60 |
| $6\frac{5}{8}$ | 5.885 | 7 |
| $5\frac{1}{2}$ | 4.892 | 30 |
| $4\frac{1}{2}$ | 4.00 | 3 |

Tests have been successfully performed in oil wells having an outer diameter of approximately seven inches (7″). The resonant frequencies of such casings have been in the order of three hundred and seventy (370) hertz. In such tests, the tubing 22 has been made of steel and has been provided with a diameter of approximately four inches (4″). The tubing 22 has been provided with a length between approximately two feet (2′0″) and forty feet (40′0″). The rings such as the rings 16 and 26 have been made of steel and have been provided with an outer diameter of approximately three and one-half inches ($3\frac{1}{2}$″) and a wall thickness of approximately one quarter inch ($\frac{1}{4}$″). The transducer members such as the transducer members 12 and 24 have been provided with an outer diameter of approximately three inches (3″). The transducer members have been made from lead zirconate and lead titanate. When more than one (1) transducer is used, the transducers may be separated from one another by a suitable distance such as approximately two inches (2″).

When electrical energy is applied to the transducer members such as the transducer members 12 and 24, the transducer members and their associated rings vibrate. These vibrations are transmitted to the tubing 22 through the oil 42 in the tubing to produce vibrations of the tubing in the "hoop" or radial mode and are then transmitted to the casing 60.through the oil in the casing. The casing 60 accordingly vibrates in the "hoop" or radial mode. These vibrations occur at the resonant frequency of the casing because the characteristics of the transducer members such as the transducer members 12 and 24, the rings such as the rings 16 and 26 and the casing 22 are selected to provide a resonance at a frequency corresponding substantially to the resonance of the casing 60.

Since the casing 60 vibrates at substantially its resonant frequency, the vibrations have a very large amplitude. These vibrations are so large that they are almost violent. This produces a flow of oil 64 into the casing 60 at a relatively high rate through the perforations 62 in the casing. This rate of flow of oil 64 into the casing is significantly higher than that provided by the prior art. The high rate of flow of oil into the casing 60 also causes gravel and sand to be packed tightly around the casing. This inhibits the tendency of sand particles to flow into the casing. Such sand particles tend to damage the oil well pump when they flow into the casing. The high rate of the flow of oil into the casing 60 is also instrumental in eliminating voids in cementing operations in the oil well.

Although this application has been disclosed and illustrated with reference to particular applications, the principles involved are susceptible of numerous other applications which will be apparent to persons skilled in the art. The invention is, therefore, to be limited only as indicated by the scope of the appended claims.

We claim:

1. In combination for facilitating the flow of oil in an oil well, a casing disposed in the oil well and perforated to provide for a flow of oil through the casing and having a particular resonant frequency, a tubing disposed in the casing in spaced relationship to the casing, transducer means disposed with the tubing and cooperative with the tubing to provide a resonant frequency for the transducer means and the tubing, indpendently of the casing, corresponding substantially to the resonant frequency of the casing, and means for energizing the transducer means at the particular resonant frequency to obtain a resonance of the casing at the particular resonant frequency through the oil in the space between the tubing and the transducer means.

2. The combination set forth in claim 1 wherein the transducer means and the tubing are constructed to provide vibrations in the hoop mode at the particular resonant frequency and the casing is constructed to resonate in the hoop mode at the particular resonant frequency independently of the vibrations of the transducer means in the hoop mode.

3. The combination set forth in claim 2 wherein the transducer means include a slotted transducer member and a slotted ring enveloping the transducer member.

4. The combination set forth in claim 3 wherein the tubing is filled with oil and the tubing, the transducer means and the oil in the tubing are resonant at substantially the particular resonant frequency independently of the resonant frequency of the casing.

5. The combination set forth in claim 4 wherein the casing is constructed to provide a resonant frequency in the hoop mode of approximately 400 hertz and the transducer means, the tubing and the oil in the tubing are provided with characteristics, independently of the resonance in the casing, to resonate at a frequency of approximately 400 hertz.

6. In combination for facilitating the flow of oil in an oil well, a casing disposed in the oil well and constructed to provide for the flow of oil into the casing from the area external to the casing and provided with a particular resonant frequency in a hoop mode, at least one transducer disposed in the casing in spaced relationship to the casing and constructed to produce vibrations in a hoop mode when energized, means including the at least one transducer disposed within the casing and constructed to resonate at the particular frequency independently of the resonance in the casing, and means operatively coupled to the transducer for energizing the transducer to obtain the production of vibrations in the transducer in the hoop mode at the particular frequency and the resonance of the casing at the particular frequency in the hoop mode through the oil between the transducer means and the casing.

7. The combination set forth in claim 6 wherein the particular resonant frequency constitutes the fundamental frequency of resonance of the casing and the transducer means.

8. The combination set forth in claim 7 wherein the transducer is made from a slotted ceramic material and the transducer means includes a ring attached to the ceramic member and slotted at a position corresponding to the slot in the ceramic member.

9. The combination set forth in claim 8 wherein the casing is defined by a cylindrical wall and is perforated to provide for a flow of oil from the area external to the casing through the perforated wall into the space within the casing in accordance with the vibrations of the casing in the hoop mode at the particular resonant frequency.

10. In combination for facilitating the flow of oil in an oil well, a hollow cylindrical casing constructed to resonate in a hoop mode at a particular fundamental frequency, the casing being constructed to provide for the passage of oil into the casing and to facilitate the passage of oil into the casing when the casing resonates in the hoop mode at the particular fundamental frequency, a cylindrical transducer member disposed in the casing in spaced relationship to the casing and slotted at one position and supported at an opposite position for vibrations, independently of the resonances of the casing, at a fundamental frequency corresponding substantially to the particular fundamental frequency, a ring disposed in the casing and slotted at a position corresponding to the slot in the transducer member and attached to the transducer member in enveloping relationship to the transducer member, and a tubing disposed in the casing in spaced relationship to the casing and enveloping the transducer member and the ring in spaced relationship to the transducer member and the ring and cooperating with the transducer and the ring to provide a resonance of the transducer member, the ring and the tubing at the particular fundamental frequency, the transducer member, the tubing and the ring being operative to transmit energy at the particular fundamental frequency to the casing through the oil in the casing between the tubing and the casing to obtain vibrations of the casing at the particular fundamental frequency.

11. The combination set forth in claim 10 wherein oil is disposed in the tubing and is operative to transmit the vibrations of the transducer member to the tubing and a rod is disposed in the tubing to support the transducer member in the tubing and to provide for the resonance of the transducer member at the fundamental frequency.

12. The combination set forth in claim 11 wherein the casing is perforated and is operative to pass oil through the perforations when the casing is resonated in the hoop mode at the particular frequency.

13. A method of facilitating the flow of fluid in an oil well, including the following steps;

providing a casing with a particular resonant frequency in a hoop mode and with characteristics to provide for a flow of oil through the casing, disposing a tubing in the casing in spaced relationship to the casing, disposing at least one transducer in the tubing in spaced relationship to the tubing, providing the combination of the transducer and the tubing with a resonant frequency in a hoop mode corresponding to the particular resonant frequency of the casing in the hoop mode and independently of the resonant frequency of the casing, providing for a vibration of the transducer to induce a resonance of the casing, through the oil in the casing, in the hoop mode at the particular resonant frequency.

14. A method as set forth in claim 13 wherein the casing is provided with perforations to obtain an enhanced flow of oil through the casing when the casing resonates at the particular frequency in the hoop mode.

15. A method as set forth in claim 14 wherein the transducer includes a transducer member slotted at a particular position and a ring attached to the outer surface of the transducer member and slotted at the particular position.

16. A method of facilitating the flow of oil in an oil well, including the following steps:

providing a hollow cylindrical casing with characteristics to resonate in a hoop mode at a particular fundamental frequency, the casing being constructed to provide for the passage of oil into the casing and to provide for an enhanced passage of oil into the casing when the casing resonates in the hoop mode in the particular fundamental frequency, disposing cylindrical transducer means within the casing in spaced relationship to the casing with characteristics to resonate in the hoop mode at the particular fundamental frequency independently of the resonant frequency of the casing, the cylindrical transducer means including at least one transducer member constructed to vibrate in the hoop mode at the particular frequency and to induce resonances of the casing in the hoop mode at the particular fundamental frequency through the oil in the casing between the transducer means and the casing, and and providing for a vibration of the transducer member in the hoop mode at the particular fundamental frequency and a resultant vibration of the casing at the particular fundamental frequency through the oil in the casing to obtain a resultant flow of oil through the casing.

17. The method set forth in claim 16 wherein the transducer member is supported at one position and is slotted at a diametrically opposite position and wherein a ring is attached to the transducer member and is slotted at a position corresponding to the slotted position of the transducer member.

18. A method as set forth in claim 17 wherein the casing is perforated to facilitate the flow of oil through the casing when the casing is resonated in the hoop mode at the particular frequency.

19. A method as set forth in claim 18 wherein oil is disposed in the tubing to transmit the vibrations of the transducer to the tubing and the oil in through the casing transmits such vibrations to the casing.

* * * * *